United States Patent [19]

Sutter

[11] Patent Number: 4,666,159

[45] Date of Patent: May 19, 1987

[54] TOY SLOT MACHINE

[76] Inventor: James J. Sutter, 100 West Grove St., Suite 100, Reno, Nev. 89509

[21] Appl. No.: 734,709

[22] Filed: May 16, 1985

[51] Int. Cl.[4] ..... A63F 5/04

[52] U.S. Cl. ..... 273/143 R

[58] Field of Search ..... 446/8, 9, 397, 475; 273/138 R, 143 R

[56] References Cited

U.S. PATENT DOCUMENTS

| | | | |
|---|---|---|---|
| D. 155,798 | 11/1949 | Gaulke | 446/8 X |
| 993,979 | 5/1911 | Gates | 446/8 X |
| 2,650,686 | 9/1953 | Bigue | 446/9 X |
| 3,406,976 | 10/1968 | Van Woert, Jr. | 446/9 X |
| 3,464,693 | 9/1969 | Bailey | 446/8 X |
| 3,747,936 | 7/1973 | Ohki | 446/9 X |
| 4,261,571 | 4/1981 | Ito | 273/143 R |
| 4,426,082 | 1/1984 | Heywood et al. | 273/143 R |
| 4,458,899 | 7/1984 | Kanno et al. | 273/138 R |
| 4,504,058 | 3/1985 | Itoh | 273/143 R |

*Primary Examiner*—Mickey Yu

*Attorney, Agent, or Firm*—John J. Byrne; Bradford E. Kile

[57] ABSTRACT

A toy money box in the form of a slot machine which has a coin store for a jackpot prize. That store has a hinged base which is normally held shut by engagement of a cam on a pivoted arm with a cam follower found on the base, displacement of the pivoted arm upon sensing of a winning combination for the chance wheels releasing the hinged base to release prize money. Additionally, a clutch mechanism is provided between the operating handle and the operating mechanism. This reduces the chance of damage to the operating mechanism should the handle be operated when the mechanism is jammed. The wheels are set in rotation by spring loaded fingers which drive said wheels, said fingers being moved to their loaded position by said clutch and engaging a stop to causing said clutch to release the fingers which spring back and spin the change wheels.

17 Claims, 9 Drawing Figures

TOY SLOT MACHINE

This invention relates to toys and in particular a toy money box which resembles a slot machine or one-armed bandit as they are sometimes called.

BACKGROUND TO THE INVENTION

Toy money boxes come in various forms from the simplest "piggy bank" which is a housing in some pleasing shape with a slot at the top in which to insert coins and an temporary opening closed by a cap or the like at the bottom or back through which the money saved can be recovered when required.

The object of the present invention is to provide a toy money box which resembles a slot machine. The latter is a complicated machine and so the toy of the invention whilst resembling the functions and optionally the appearance of a slot machine must be relatively simpler in operation and must have a construction which can accept the type of abuse and misuse to which toys are subject without damage to its operating functions.

BRIEF SUMMARY OF THE INVENTION

According to the invention in one aspect there is provided a toy money box comprising a first coin inlet, a money store into which coins pass when inserted into said first coin inlet, a base to said money store hingedly mounted so as to be movable between a normally closed position to retain coins in said store and an open jackpot position to release coins from said store, a number of rotatable chance wheels arranged to be spun and stopped at random orientations, indicia carried by said wheels, certain indicia being winning indicia when a respective wheel stops with those indicia in a winning orientation, whereby when all wheels stop in a winning orientation that corresponds to said jackpot position, a pivoted arm resiliently urged to move said base to said normally closed position, cam means carried by said pivoted arm and engaging a cam follower on said base, said cam means including a cam surface capable of resiliently engaging said base to said normally closed position, and a latch surface engaged by said cam follower when said base reaches said normally closed position to support and hold said base closed, and sensor means for engaging said wheels to detect alignment of winning indicia, said sensor means being resiliently urged to a second position but stopped at a first position when the said wheels are not in a jackpot position, said sensor means being movable to said second position when a jackpot position is detected, said sensor means engaging said pivoted arm when they move to said second position to displace said arm and release said base and allow said base to hinge open.

With such a money box the coins are held in the money store until a winning jackpot is shown when they are automatically released. Preferably there is a second coin inlet leading to a money storage compartment say in the base of the toy so that some money can be placed in the money store for release as a jackpot and some placed in the money storage compartment for saving.

Preferably the base to the money store is hingedly mounted and can hinge downwardly under its own weight when a jackpot prize is given, the base being held shut by engagement of a circular cam pin integrally formed with the base which fits an arcuate shaped latch on said cam means to support said base in its closed position.

According to another aspect of the invention there is provided a toy money box comprising a first coin inlet, a money store into which coins pass when inserted through said first coin inlet, a number of rotatable chance wheels arranged to be spun and stopped at random orientations, indicia carried by said wheels, certain indicia being winning indicia when a respective wheels stops with those indicia in a winning orientation, whereby when all wheels stop in a winning orientation that corresponds to a jackpot position, means for determining a jackpot position and releasing stored coins from said money store upon determination of a jackpot position, a pivoted handle for setting said wheels spinning, a spring loaded finger for engaging respective wheels, said fingers being movable to a loaded position in contact with said wheels whereby their release spins a respective wheel as said finger moves to a retracted rest position, and a clutch mechanism driven by said handle, said clutch moving said fingers to said loaded position when said handle is initially pivoted, a stop to limit movement of said fingers when they reach said loaded position, further pivoting of said handle releasing said clutch whereby said fingers can then move to said retracted rest position.

The provision of the clutch mechanism also has a safety aspect since it ensures that if the toy's operating mechanism becomes jammed, operation of the handle will not damage the mechanism since instead the clutch will release.

BRIEF DESCRIPTION OF THE DRAWINGS

An example of a toy slot machine and money bank according to the invention will now be described with reference to the accompanying drawings, in which.

DESCRIPTION OF THE PREFERRED EMBODIMENT

Figure 1:
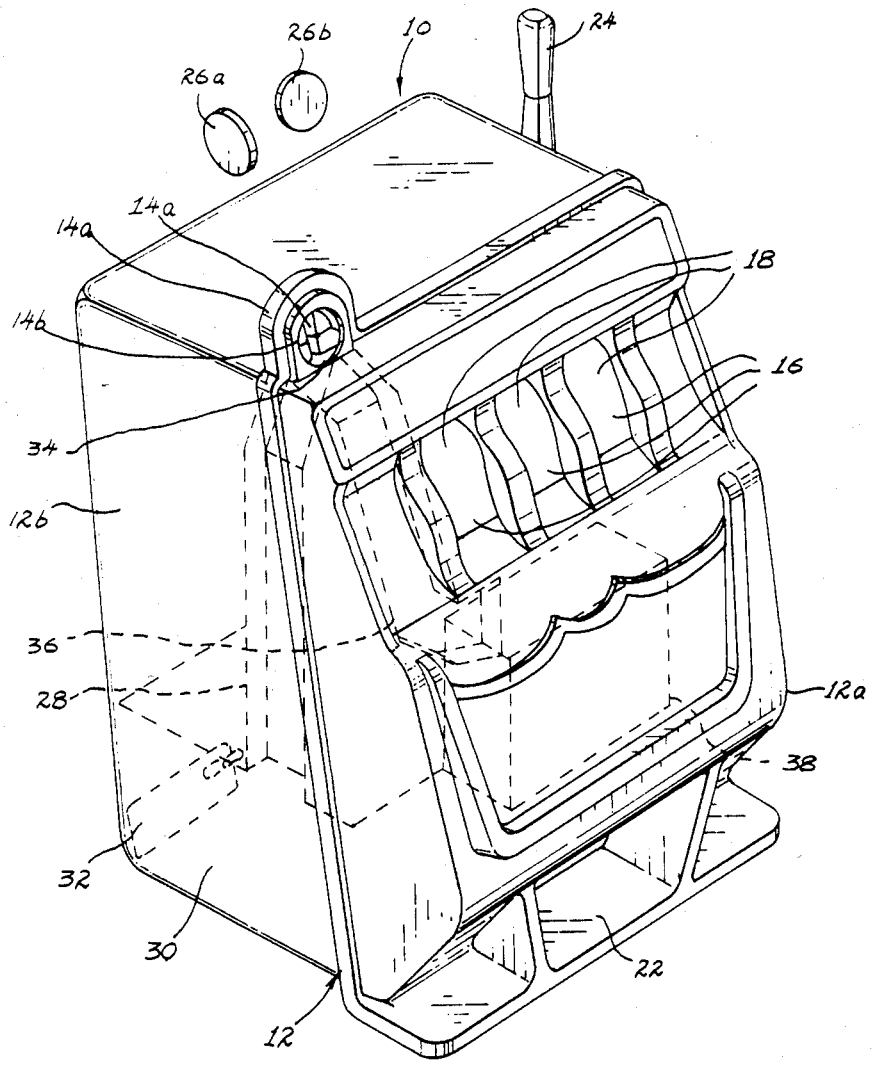
FIG. 1 is a perspective view with parts broken away.

The toy slot machine bank 10 is shown in FIG. 1. It includes an outer casing 12 in the shape of a conventional slot machine. The casing includes a front section 12*a* and a rear rectangular housing section 12*b*. At the top is a coin input 14. In the front section are three slots 16 through which the peripheries of three chance wheels 18 are visible.

Figure 2:
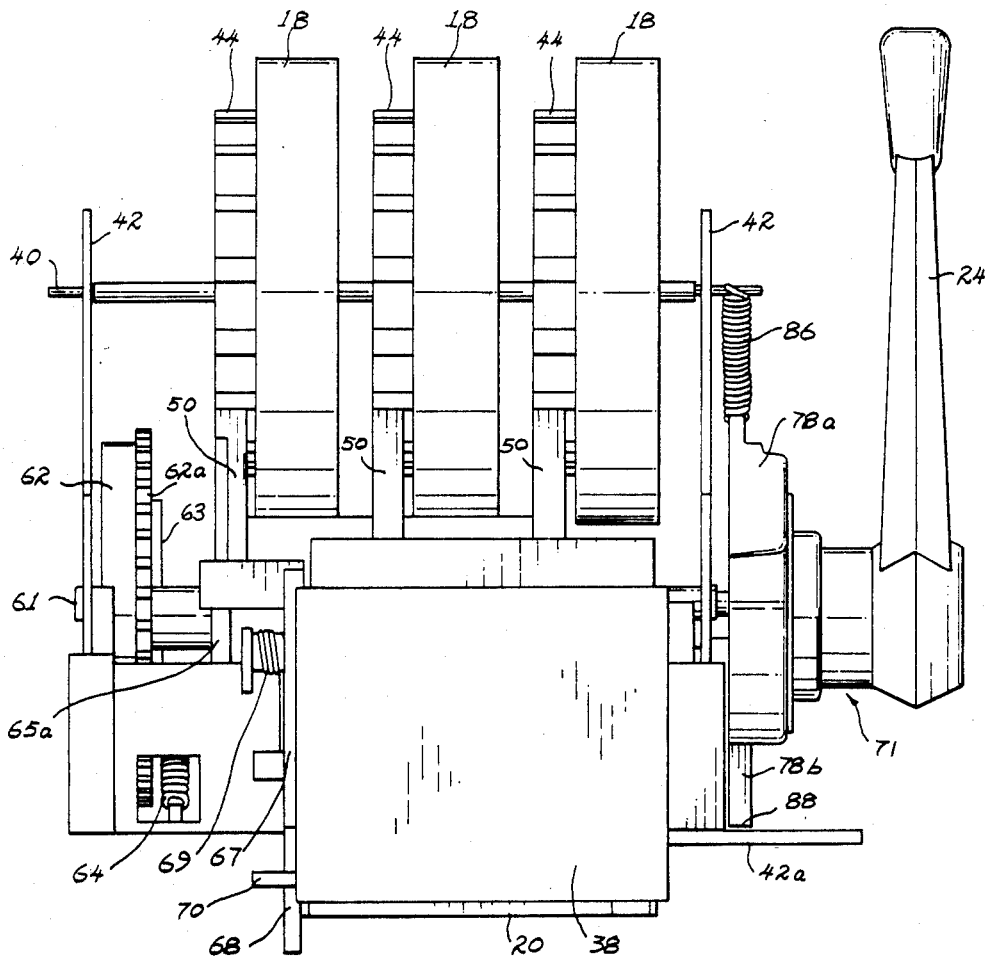
FIG. 2 is a front elevational detail of the mechanism for rotating and stopping the chance wheels.

These wheels carry markings around their peripheries including winning marks such as BAR and "7" and when all three wheels stop in a position say with a combination of three BAR and/or "7" marks all aligned then that is associated with a jackpot prize. A door or base 20 (FIG. 2) will then open to release stored coins through outlet 22 in the front section 12*a* of the casing 12. The bank also has a hinged lever or handle 24 which is used to operate the wheels 18. The operation of the bank 10 to actuate the wheels 18 is, however, independent of the deposit of a coin.

As best shown in FIG. 1 the coin input 14 has two inlets. A first inlet will accept a coin in the position 26*a* and is in the form of a slot 14*a* when viewed from the front of the casing 12. Such a coin can pass down a chute 28 to a money storage compartment 30 in the base. Such a coin is saved as in any "piggy bank" and when collected coins are needed, they can be removed by opening a door 32 at the base of the rear housing 12*a* of the casing 12.

The coin input 14 also has a second inlet 14*b* which will accept a coin in the position 26*b*. This is in the form of a circular opening as seen from the front of the casing. This leads to a slot 34 transverse to the slot 14*a* and coins passing through enter a chute 36 which leads to a coin collecting box 38. The latter acts as a jackpot prize store so that coins entered through the second inlet 14*b* are temporarily stored until released through the door 20 which forms the bottom of the box 38.

The owner of the bank 10 can therefore enter some coins through the slot 14*a* to store them as in any piggy bank whilst others can be entered through the inlet 14*b* and they will be kept as a prize to be released when a prize is awarded. Unlike a conventional slot machine there is no question of a proportion of the money entered being retained by the machine; the bank 10 is a toy and the user has the choice of placing coins either in the compartment 30 for long term storage or in the box 38 for release as a prize from time to time.

Referring now more particularly to FIGS. 2 to 6, the chance wheels 18 are rotatably mounted on an axle 40 carried by a metal frame 42 supporting the operating mechanism. As noted above and as best shown in FIG. 4, around the periphery of each wheel are a series of markings, some forming parts of arrays constituting winning scores such as BAR or "7" and others such as an orange, lemon or cherries forming parts of arrays constituting a losing score. Integrally projecting from the side face of each wheel are a circular set of teeth 44 analogous to the teeth of a gear wheel. The teeth have crests 44*a* and troughs 44*b*. It will be seen best from FIG. 4 that certain troughs are missing. Those missing correspond to, but are not necessarily angularly aligned with, marking which form part of a winning array. For example the missing trough indicated by the reference 44*c* corresponds with the winning marking "7" marked with the reference 46.

On the one hand the teeth 44 on each wheel 18 are engaged by respective stop levers 48 and on the other hand they are engaged by sensing levers 50. The heads of the levers 48 are triangular in shape and have a pointed nose 48*a* which will engage in any trough between any pair of crests 44*a* of the teeth 44, irrespective of whether the corresponding trough 44*b* between any pair of crests 44*a* is missing. Thus the nose 48*a* is too large to pass through a missing trough and engages the faces of any adjacent pair of teeth.

The wheels 18 are set in rotation as will be described and the levers 48 and 50 will also have been pivoted clear of the teeth as will be described. Then the levers 48 are released and pivot under the force of springs 52 into engagement between a random pair of teeth 44 to stop rotation of the appropriate wheel and temporarily to lock the wheel in a random set position.

The levers 48 are each pivotally mounted at the end remote from the noses 48*a* about a rod 54 carried by the frame 42. The springs 52 urge the noses 48*a* of the levers towards the teeth 44. Each lever also has a cam face 48*b* intermediate its ends. These cam faces are engaged by a pivotably mounted wing member 56 such that when the wing member is pivoted up to the position shown in broken lines in FIG. 5 the noses of the levers 48 are moved away from engagement with the teeth 44 to the position shown in broken lines in FIG. 5 and when in the position shown in full lines in FIG. 5 they are freed from engagement and the noses are able to be moved by the respective springs into engagement with the teeth 44.

Figure 3:
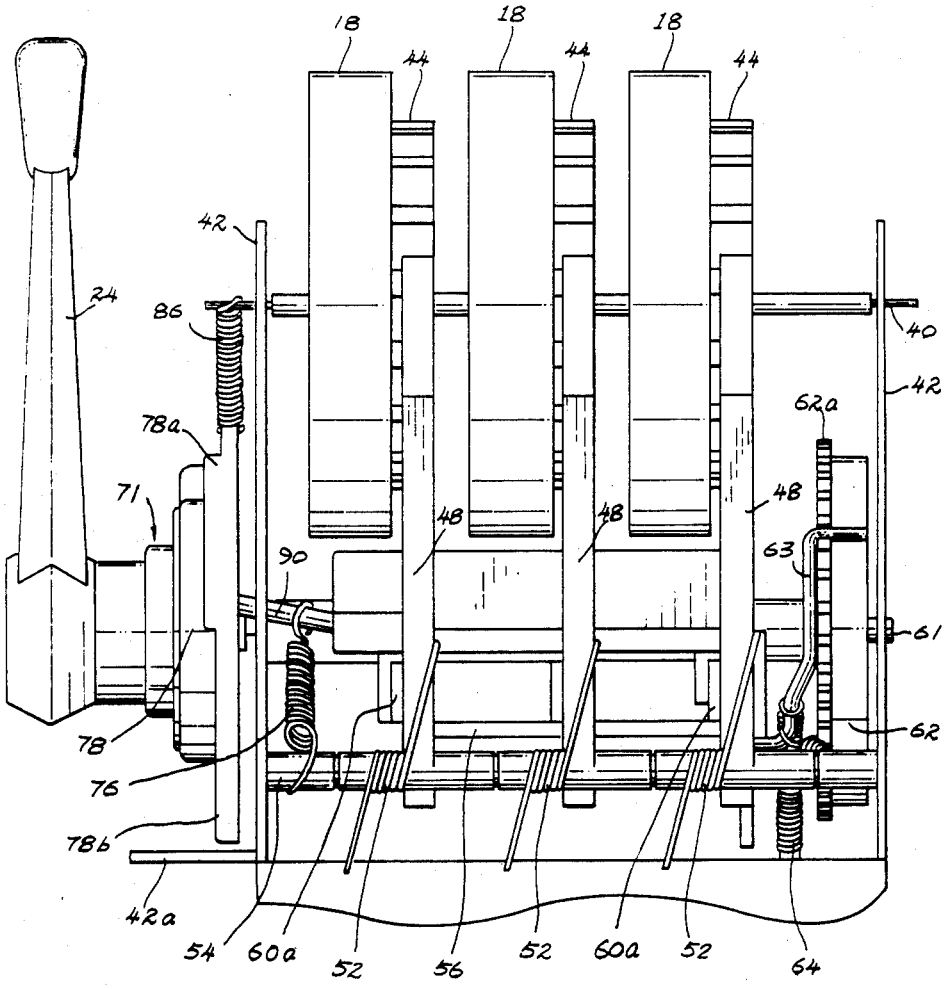
FIG. 3 is a rear elevational detail of the mechanism shown in FIG. 2.
Figure 4:
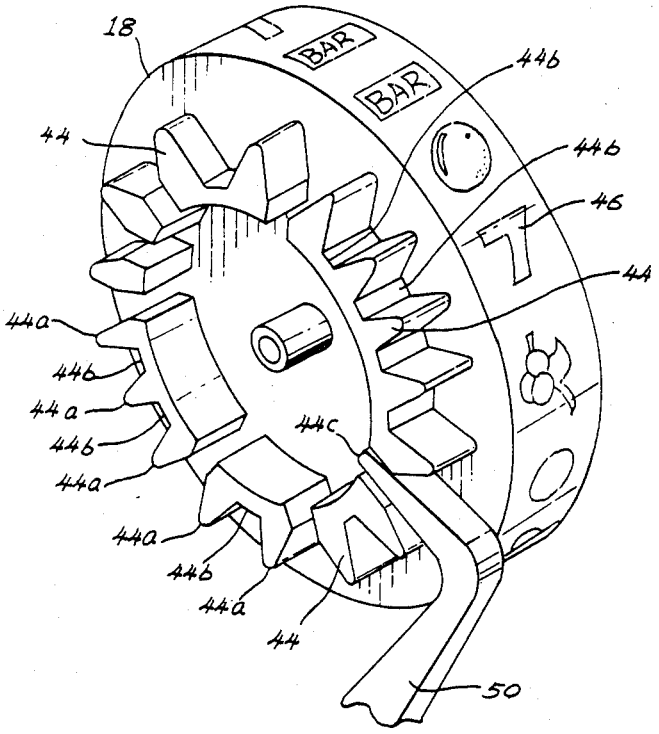
FIG. 4 is a perspective detail of one of the chance wheels.
Figure 5:
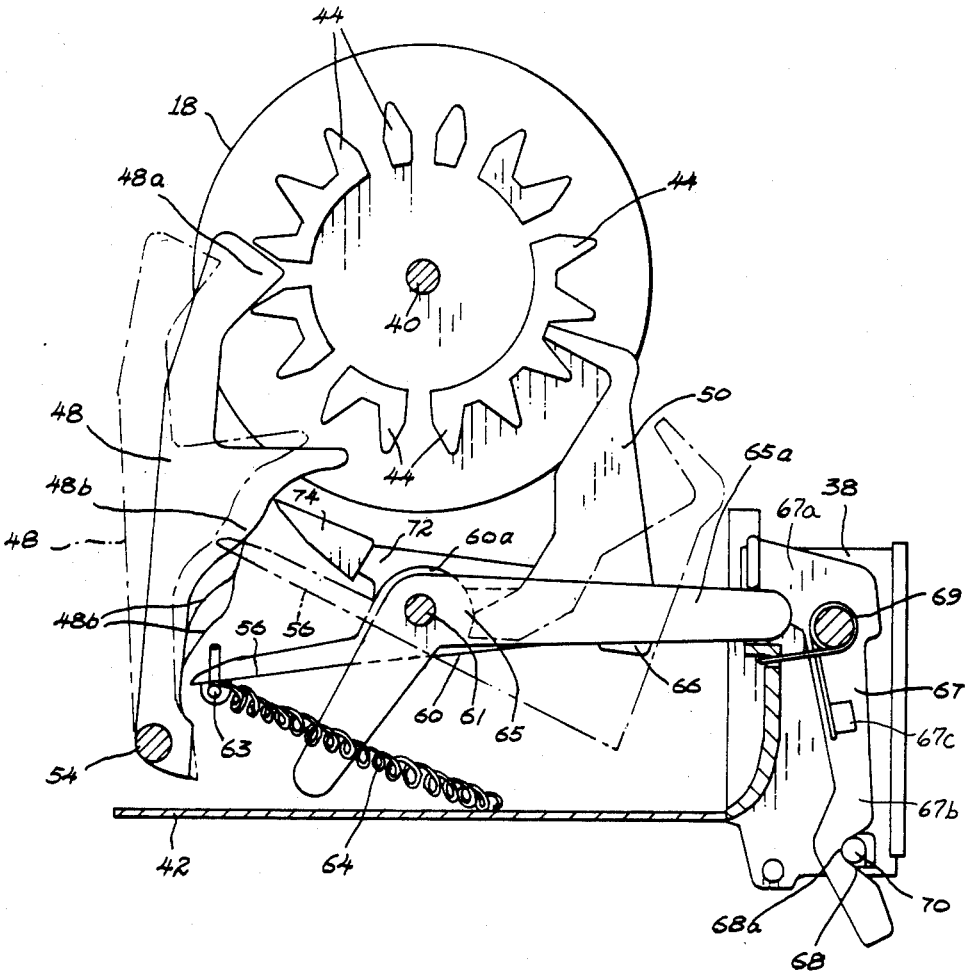
FIG. 5 is a sectional detail showing the parts controlling the release of the money door and spinning and stopping of the wheels.
Figure 6:
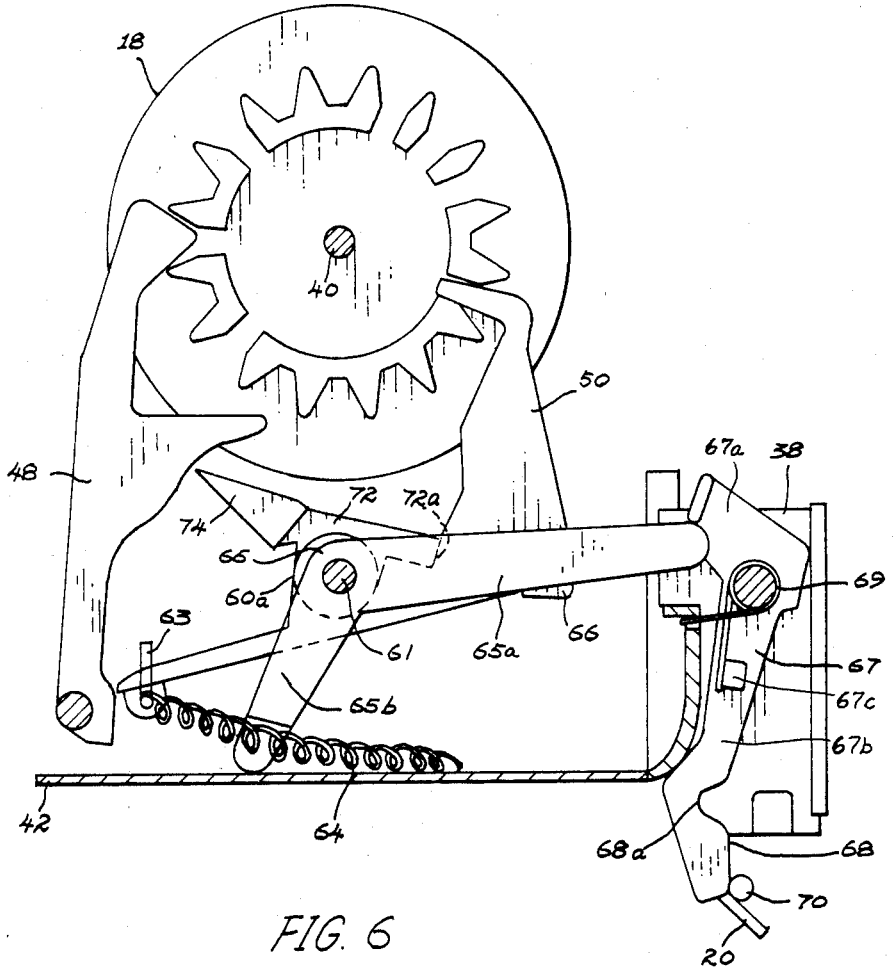
FIG. 6 is a detail similar to FIG. 5 with the money door in the open position.

It will be noted from FIG. 5 that the cam faces 48*b* of the three levers 48 vary such that as the member 56 progressively moves to its full line position in FIG. 5 first of all the right-hand lever 48 as viewed in FIG. 3, then the middle and finally the left hand lever 48 are released to allow their respective noses 48*a* to engage the teeth 44 and stop the respective wheels 14. In this way the wheels are stopped in turn, one by one. In order to space out the stopping of the wheels 18 in this way, a damper 62 is also mounted on the axle 61. This has teeth 62*a* on its outer periphery engaged by a link 63 also pivotably joined to the wing member 56. The link 63 is resiliently urged by a spring 64 to move the member 60 in an anti-clockwise sense. The damper 62, which contains a silicone grease as the damping agent, ensures that the spring 64 can only move the member 60 slowly.

The three sensing levers 50 are integrally formed as fingers upstanding from a member 60 of which the wing member 56 also forms part. The member is pivotally mounted to the frame 42 about an axle 61 by means of a pair of lugs 60*a*. Since the three levers 50 are joined and so can only move together, the three respective noses 50*a* can only enter a missing trough 44*b* when all three happen to be aligned with missing troughs. In other words the member 60 and the associated levers can only move from the position shown in FIG. 5 to the position shown in FIG. 6 when a winning combination of marks is shown by the chance wheels 18. Additionally the damper 62 ensures that they will in any case be delayed until after the three wheels have been first of all stopped in turn by the levers 48 and in this connection it will be noted that the cam surface 48*b* are shaped so that the noses 48*a* engage on all three wheels long before the levers 50 engage the teeth 44.

Pivotally mounted about the axle 61 is a two armed crank 65. One arm 65*a* rests on a lug 66 forming part of the member 60. Additionally, that arm 65*a* abuts part of the frame 42 and so even when the member 60 moves to the broken line position shown in FIG. 5, the lug 66 moves clear of the arm 65*a* but the crank still cannot move. When the member 60 moves from the position shown in FIG. 5 to the position shown in FIG. 6, however, the lug 66 lifts the arm 65*a*. The extent of lifting is however limited since the other arm 65*b* of the crank quickly contacts the frame 42 and so the extent of penetration of the respective noses 50*a* in between the teeth 44 of the respective wheels is limited. It is, however, sufficient to sense a winning combination and to actuate the door 20 as will now be described.

The other end of the arm 65*a* contacts a pivotally mounted crank 67 having arms 67*a* and 67*b*. At the lower end has a cam surface 68. Bearing against the latter surface is an arm 70 formed integrally with the hinged door 20 at the lower end of the coin box 38. The crank 67 is urged by a spring 69, engaging a stop 67*c* on the arm 67*b*, in an anti-clockwise direction as viewed in FIG. 5 towards the position shown in that figure.

The arm, 70 has a circular cross-section which fits a rounded latch surface 68*a* of the cam surface 68. When the arm fits in that surface 68*a* it and its associated door are supported. Thus the weight of any coins in the coin box will be carried by the crank 67 and the door will remain closed and the spring 69 will urge the crank 67 into such a position. Once the crank 67 is pivoted against the effect of the spring 69 by the raising of the arm 65*a* which engages a projection 67*d* on the arm 67*a* of the crank 67, pivoted to the position shown in FIG. 6. This releases the arm 70 and the door 20 will hinge downwardly under its own weight to release any coins in the box 38.

When the member 60 is moved back to retract the noses 50*a* from the missing troughs 44*b* and the chance wheel are to be operated again, crank 65 releases the crank 67 which is pivoted by the spring 69 back to the position shown in FIG. 5 and the cam surface 68 bears on the arm 70 and causes the door 20 to pivot up to its closed position. It is then held in that position as before until again released.

It will also be noted that the lower end of arm 67*b* of the the crank 67 extends down into the outlet 22, and if desired a child can depress it to release the door 20. This saves possible damage to the door 20 and arm 70 if a child tries to force the door 20 open.

As noted above the toy 10 has a hinged handle 24 for operating the chance wheels 18. The handle is attached to a clutch 71 rotatably carried by the axle 61. In turn the clutch 71 is connected to drive a member 72 also pivotally mounted about the axle 61. It has a front contact surface 72*a* which bears against the levers 50 of the member 60 and has three integrally formed operated fingers 74, one mounted in alignment with a respective set of teeth 44.

Figure 7:
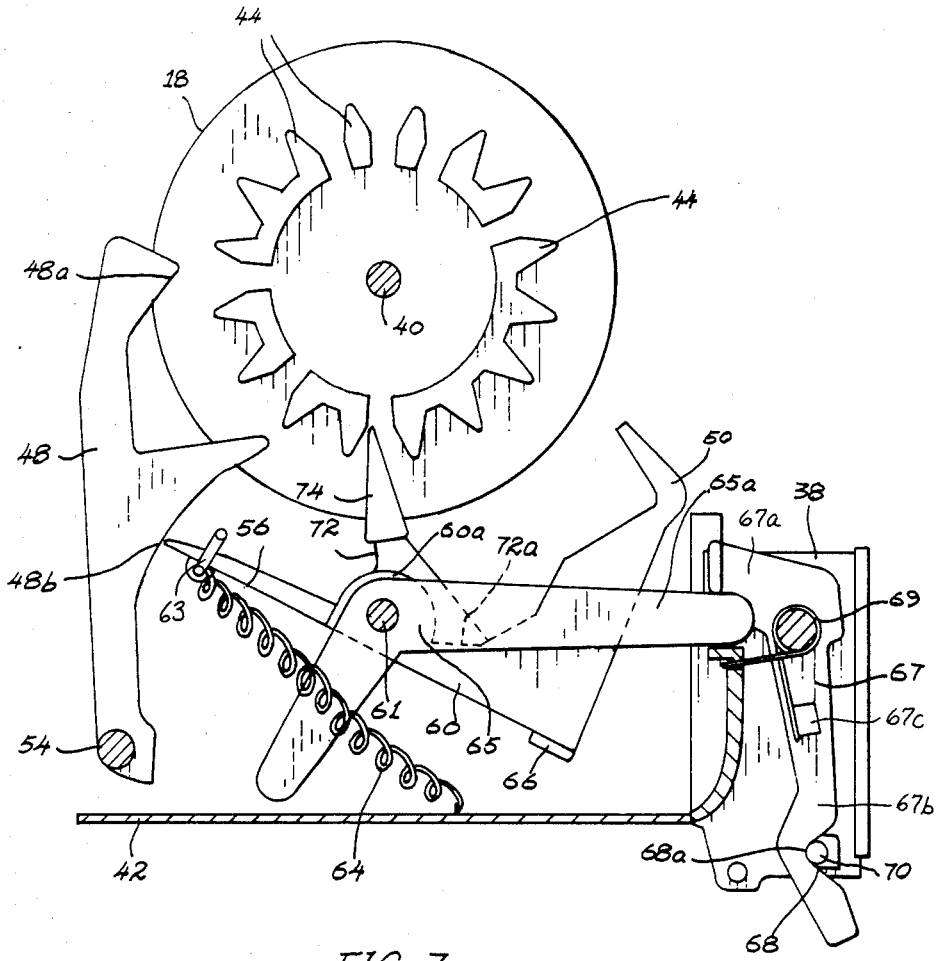
FIG. 7 is a detail similar to FIG. 5 showing the wheels about to be spun.
Figure 9:
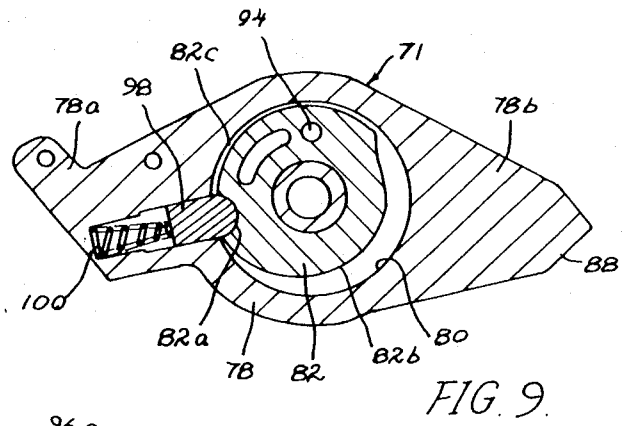
FIG. 9 is a sectional detail of part of the handle actuating mechanism.

As the member 72 is pivoted clockwise in the sense viewed in FIG. 7, to the position shown in that Figure, in a manner to be described, then the contact surface 72*a* engages the member 60 and causes the member 60 to pivot likewise. This withdraws the levers 50, and since the lug 66 ceases to contact the arms 65*a*, the latter contacts the casing 42 and allows the door 20 to shut if it was open. The pivoting of the member 60 also causes the wing member 56 to engage the cam surfaces 48*b* on the levers 48 and additionally withdraw them so that their respective noses 48*a* no longer engage the teeth 44. The wheels are therefore free to rotate as regards the levers 48 and 50. However pivoting of the member 72 raises the pivoted fingers 74 which engage in the teeth 44 of the respective wheels 18.

Figure 8:
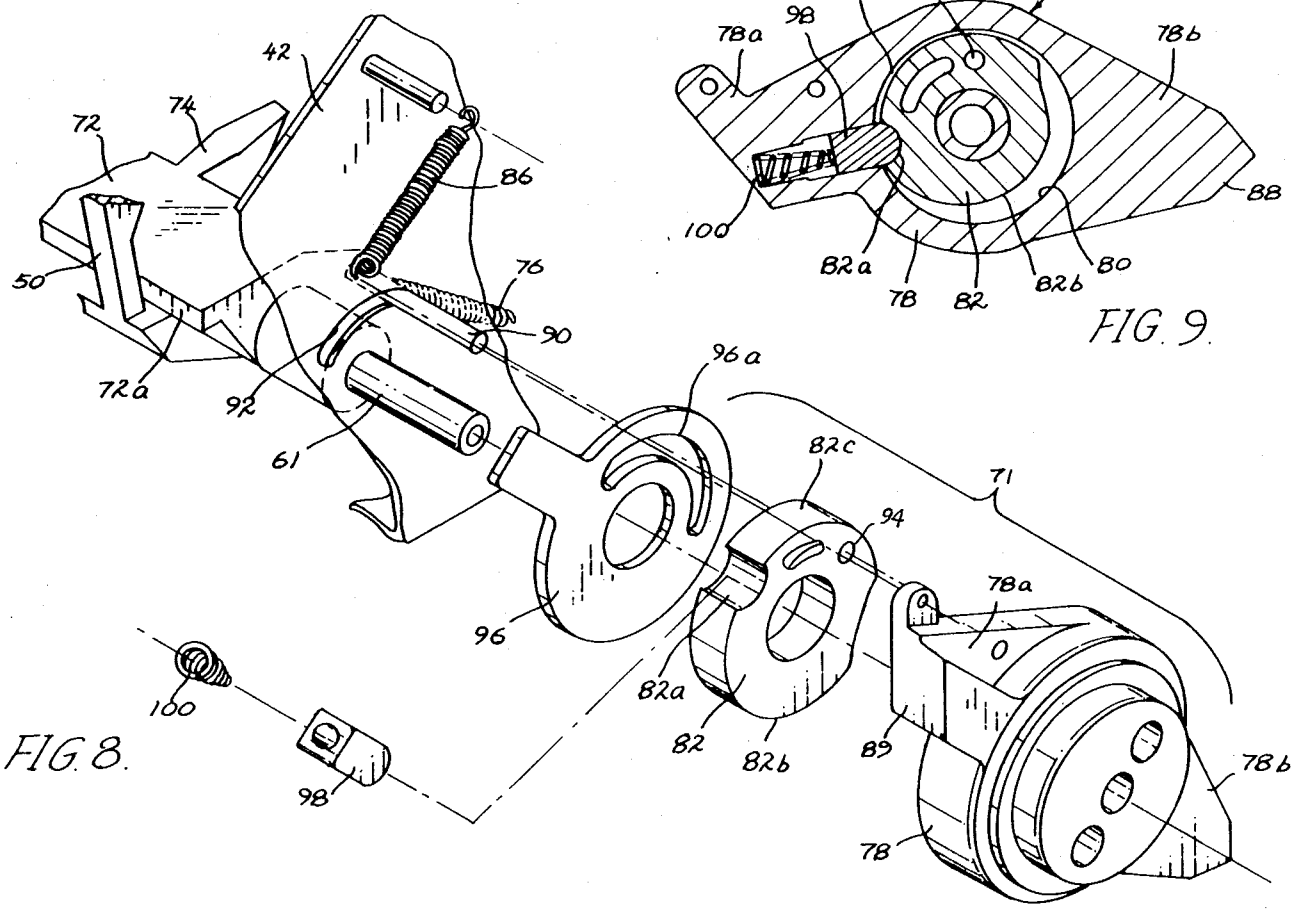
FIG. 8 is an exploded view of the parts of the handle actuating mechanism.

Attached between the member 72 and the casing 42 is a strong coil spring 76, FIGS. 3 and 8, and the member 72 is pivoted to the position shown in FIG. 7 against the action of that spring. As will be described the clutch 71 suddenly releases the member 72, which can therefore snap back rapidly to its rest position shown in FIGS. 5 and 6. The resulting engagement of the fingers 74 with the teeth 5 of their respective wheels cause the wheels to spin rapidly in a clockwise sense as viewed in FIG. 7. Because of the damper 62, the levers 48 and 50 do not immediately engage and stop this spinning of the wheels but one by one the levers 48 stop their respective wheels at a random point and then the levers 50 engage the wheels to sense whether the wheels have stopped, at a winning combination.

The clutch 71 includes an outer housing 78 in the shape of a two-armed crank. It is rigidly attached by screws (not shown) to the handle 24. It has a circular hollow 80 within which is mounted a cam 82 and has a first arm 78*a* which is attached to a spring 86 fixed to the casing 42 and a second arm 78*b* whose outer end has a stop surface 88 which engages a ledge 42*a* forming part of the frame 42. The arm 78*b* also has a stop surface 89 engageable with the ledge 42*a* when the handle is at its other extreme position.

The member 72 has a metal pin 90 projecting from its end through a slot 92 in the casing into a hole 94 in the cam 82 to join the two for rotation together. The pin 90 also forms the annular point for attaching the spring 76 to the member 72. A cover member 96 encloses the cam 82 and hollow 80 and has a curved slot 96*a* through which the pin 90 extends.

The cam 82 has an arcuate recess 82*a* engageable by the corresponding head of a small catch 98 spring loaded by a spring 100 into engagement with the cam 82. Additionally the cam has a cam surface 82*b* of initially narrowing diameter which is engageable by the head of the catch 98 when the latter becomes displaced from the recess 82*a*.

Initially the catch 98 engages in the recess 82*a* and so locks the cam 82 and outer housing 78 of the clutch together. Therefore when the handle is pivoted forwardly the member 72 is pivoted because of the engagement if the pin 90 with the cam 82 against the action of the spring 90. Additionally as noted above this moves the levers 48 and 50 clear of the wheels 18 and engages the fingers 74 with the teeth 44. Eventually the pivoting of the handle reaches a point where the pin 90 engages the end of the slot 92 and so cannot pivot any further. Continued pull on the handle 24 causes the catch 98 to leave the recess 82*a*. The member 72 is therefore suddenly free to move to its initial position under the effect of the spring 76 which as explained above sets the wheels 18 spinning. The head of the catch 98 travels freely over the cam surface 82*b*. The handle can now be released, engagement of the surface 89 with the ledge 42*a* preventing further forward movement, and the handle is returned to its upright position by the spring 86, the engagement of the surface 88 with the ledge 42*a* defining the limit of movement in the return direction. As the handle returns to its upright position, the head of the catch 98 travels over the surface 82b gradually compressing the spring 100 until the clutch snaps into the recess 82*a* and the cam 82 and outer housing 78 again become linked by that engagement.

The clutch 71 functions also as a safety device. Thus should any part of the mechanism of the toy become jammed, operation of the handle 24 will not break any parts but instead the clutch will release It should be noted in this connection that the catch 98 can release from the recess 82*a* in either direction, the head travelling over the surface 82*c* opposite to the surface 82*b* if necessary. I have also found that there is the further incidental advantage of the surface 82*b* which is that, if the spring 76 fails, the engagement of the catch 98 with that surface under the effect of the spring 100 will also quickly restore the member 72 when the pin 90 reaches the end of the slot 92 to spin the wheels 18, although not as rapidly as does the spring 76.

It is believed that the operation and advantages of the toy 10 will be apparent from the above description. In particular the operating mechanism is designed to reduce the chances of damage upon misuse such as will occur with a toy.

A latitude of modification, change and substitution is intended in the foregoing disclosure and in some instances some features of the invention will be employed without a corresponding use of other features Accordingly it is appropriate that the appended claims be construed broadly and in a manner consistent with the spirit and scope of the invention herein.

I claim:

1. A toy money box comprising:

an outer casing;

a first coin inlet formed in said casing;

a money store within said casing into which coins pass when inserted into said first coin inlet;

a base to said money store hingedly mounted to said casing at the outer surface thereof so as to be movable by hinging downwardly under its own weight between a normally closed position to retain coins in said store and an open jackpot position to release coins from said store;

a number of rotatably chance wheels mounted in said casing and arranged to be spun and stopped at random orientations;

indicia carried by said wheels, only certain of said indicia being winning indicia when a respective wheel stops with one of said certain indicia in a winning orientation, whereby when said wheels stop in a winning orientation the resulting array of indicia corresponds to movement of said base to said jackpot position;

an arm pivotably mounted in said casing and resiliently urged to move said base to said nornally closed position; pivoted arm and cam means carried by said engaging a circular cam follower pin integrally formed with said base, said cam means including a cam surface capable of resiliently engaging said cam follower pin to cam said base to said normally closed position, and a latch surface engaged by said cam follower pin when said base reaches said normally closed position, said latch surface being of an arcuate shape into which said cam follower pin fits for support in said closed position of said base to support and hold said base closed; and sensor means pivotably mounted in said casing for engaging said wheels to detect winning orientation of winning indicia, said sensor means being resiliently urged to a second position but stopped at a first position when the said wheels are not all stopped in a winning orientation, said sensor means being movable to said second position when a jackpot position is detected, said sensor means engaging means for moving said pivoted arm when they move to said second position to displace said arm and release said cam follower pin from said latch surface to allow said base to hinge open.

2. A toy money box according to claim 1 further comprising a circular set of gear teeth integrally formed in one side face of each chance wheel, said teeth comprising alternative crests and troughs with selected troughs absent, absence of a trough corresponding to a winning indicia, said sensor means detecting a winning indicia by being capable of moving to said second position through an absent trough and being stopped at said first position by a trough.

3. A toy money box according to claim 2 in which said sensor means includes a member pivotally mounted in said casing and having integrally formed sensing fingers thereon, each of said fingers having an outer narrow end capable of engaging in a trough to define said first position and passing through a missing trough to allow said member to move to said second position when all of said fingers pass through a missing trough simultaneously.

4. A toy money box according to claim 3 in which said sensor means further includes sensing levers one associated with each respective wheel, and a crank acting as a link between said pivoted arm and said sensing levers.

5. A toy money box according to claim 2 further comprising a stopping lever associated with each respective wheel resiliently mounted in said casing, said levers having an outer end capable of engaging said teeth of a respective wheel to stop rotation at a random orientation, means being provided to withdraw said levers prior to spinning said wheels and to release said levers to engage said teeth after said wheels have been set spinning.

6. A toy money box according to claim 5 further comprising damping emans mounted in said casing to delay movement of said stopping levers to engage said teeth.

7. A toy money box according to claim 1 and further comprising:

a handle pivotally mounted to said outer surface of said casing for setting said wheels spinning;

a spring loaded finger for engaging respective wheels mounted in said casing;

said fingers being movable to a loaded position in contact with said wheels whereby their release spins a respective wheel as said finger moves to a retracted rest position; and a clutch mechanism driven by said handle, said clutch mechanism moving said fingers to said loaded position when said handle is initially pivoted, a stop to limit movement of said fingers when they reach said loaded position, further pivoting of said handle releasing said clutch whereby said fingers can then move to said retracted rest position.

8. A toy money box according to claim 7 in which said clutch mechanism includes an outer housing to which said handle is attached, a hollow within said housing, a cam mounted within said housing and attached to said fingers, a cam surface on said cam including a recess, a catch supported by said outer housing and resiliently urged into contact with said cam surface, whereby engagement of said catch in said recess connects said housing and cam but said catch is releasable when said stop limits moving of said fingers.

9. A toy money box comprising:

an outer casing;

a first coin inlet formed in said casing;

a money store within said casing into which coins pass when inserted into said first coin inlet;

a number of rotatably chance wheels mounted in said casing and arranged to be spun and stopped at random orientations;

indicia carried by said wheels, only certain of said indicia being winning indicia when a respective wheel stops with one of said certain indicia in a winning orientation, whereby when said wheels stop in a winning orientation the resulting array of indicia corresponds to a jackpot position whereby stored coins are released from said money store;

means within said casing fro determining said jackpot position and releasing stored coins from said money store upon determination of said jackpot position;

a handle pivotally mounted to said casing at an outer surface thereof for setting said wheels spinning;

spring loaded fingers mounted in said casing for engaging respective wheels; said fingers being movable to a loaded position in contact with said wheels whereby their release spins respective wheels as said fingers move to a retracted rest position;

a clutch mechanism driven by said handle, said clutch mechanism moving said fingers to said loaded position when said handle is initially pivoted;

a stop to limit movement of said fingers when they reach said loaded position, further pivoting of said handle releases said clutch whereby said fingers can then move to said retracted rest position; and said clutch mechanism including an outer housing to which said handle is attached, a hollow within said housing, a cam mounted within said housing and attached to said fingers, a cam surface on said cam including a recess, a catch supported by said outer housing and resiliently urged into contact with said cam surface, whereby engagement of said catch in said recess releasably connects said housing and cam but said catch is releasable from said cam when said stop limits movement of said fingers.

10. A toy money box according to claim 9 and further comprising:

a base to said money store hingedly mounted to said casing at the outer surface thereof so as to be movable by hinging downwardly under its own weight between a normally closed position to retain coins in said store and an open jackpot position to release coins from said store corresponding to said wheels being stopped at said winning orientation;

an arm pivotably mounted in said casing and resiliently urged to move said base to said normally closed position;

cam means carried by said pivoted arm and engaging a circular cam follower pin integrally formed with said base, said cam means including a cam surface capable of resiliently engaging said cam follower pin to cam said base to said normally closed position, and a latch surface engaged by said cam follower pin when said base reaches said normally closed position, said latch surface being of an arcuate shape into which said cam follower pin fits for support in said closed position of said base to support and hold said base closed; and sensor means pivotably mounted in said casing for engaging said wheels to detect winning orientation of winning indicia, said sensor means being resiliently urged to a second position but stopped at a first position when the said wheels are not all stopped in a winning orientation, said sensor means being movable to said second position when a jackpot position is detected, said sensor means engaging means for moving said pivoted arm when they move to said second position to displace said arm and release said cam follower pin from said latch surface to allow said base to hinge open.

11. A toy money box according to claim 10 further comprising a circular set of gear teeth integrally formed in one side face of each chance wheel, said teeth comprising alternative crests and troughs with selected troughs absent, absence of a trough corresponding to a winning indicia, said sensor means detecting a winning indicia by being capable of moving to said second position through an absent trough and being stopped at said first position by a trough.

12. A toy money box according to claim 11 in which said sensor means includes a member pivotally mounted in said casing and having integrally formed sensing fingers thereon, each of said fingers having an outer narrow end capable of engaging in a trough to define said first position and passing through a missing trough to allow said member to move to said second position when all of said fingers pass through a missing trough simultaneously.

13. A toy money box according to claim 12 in which said sensor means further includes sensing levers one associated with each respective wheel, and a crank acting as a link between said pivoted arm and said sensing levers.

14. A toy money box according to claim 11 further comprising a stopping lever associated with each respective wheel resiliently mounted in said casing, said levers having an outer end capable of engaging said teeth of a respective wheel to stop rotation at a random orientation, means being provided to withdraw said levers prior to spinning said wheels and to release said levers to engage said teeth after said wheels have been set spinning.

15. A toy money box according to claim 14 further comprising damping means mounted in said casing to delay movement of said stopping levers to engage said teeth.

16. A toy money box according to claim 12 further comprising a stopping lever associated with each respective wheel resiliently mounted in said casing, said levers having an outer end capable of engaging said teeth of a respective wheel to stop rotation at a random orientation, means being provided to withdraw said levers prior to spinning said wheels and to release said levers to engage said teeth after said wheels have been set spinning.

17. A toy money box according to claim 16 further comprising damping means mounted in said casing to delay movement of said stopping levers to engage said teeth, movement of said fingers to said loaded position contacting said stopping levers to withdraw them, and retracting said sensing fingers from contact with the respective teeth, and release of said fingers releasing said stopping levers and sensing fingers for said damping means to delay their return.

* * * * *